US006758704B2

(12) United States Patent
Funayose et al.

(10) Patent No.: US 6,758,704 B2
(45) Date of Patent: Jul. 6, 2004

(54) ELECTRICAL COMPONENT MOUNTING STRUCTURE FOR PERSONAL WATERCRAFT

(75) Inventors: Yusuke Funayose, Saitama (JP); Tomohiko Yashiro, Saitama (JP); Toru Hasegawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/283,270

(22) Filed: Oct. 30, 2002

(65) Prior Publication Data

US 2003/0131774 A1 Jul. 17, 2003

(30) Foreign Application Priority Data

Oct. 31, 2001 (JP) ..... 2001-334029

(51) Int. Cl.[7] ..... B63H 21/22
(52) U.S. Cl. ..... 440/1; 440/38
(58) Field of Search ..... 440/89 R

(56) References Cited

U.S. PATENT DOCUMENTS 5,879,211 A * 3/1999 Koyanagi ..... 440/89 R
6,155,896 A * 12/2000 Suzuki ..... 440/89 R

FOREIGN PATENT DOCUMENTS

JP 10194195 A 7/1998

* cited by examiner

*Primary Examiner*—Stephen Avila
(74) *Attorney, Agent, or Firm*—Birch, Stewart, Kolasch & Birch, LLP

(57) ABSTRACT

An electrical component mounting structure for a personal watercraft which simplifies a waterproof treatment of the electrical components. The structure includes an exhaust outlet of the exhaust pipe formed on one side of the body of the personal watercraft in a lateral direction. In this personal watercraft, a plurality of electrical components is disposed in the body so as to be offset on the one side from a central portion in the lateral direction. In other words, none of these electrical components is disposed in the vicinity of a wall surface on the other side of the body. The electrical components are preferably disposed in the body at an intermediate portion in the vertical direction, and at least one of a plurality of the electrical components is preferably mounted to a side wall constituting the one side of the body.

13 Claims, 15 Drawing Sheets

ELECTRICAL COMPONENT MOUNTING STRUCTURE FOR PERSONAL WATERCRAFT

CROSS-REFERENCE TO RELATED APPLICATION

The present application claims priority under 35 U.S.C. §119 to Japanese Patent Application No. 2001-334029, filed on Oct. 31, 2001, the entire contents of which are hereby incorporated by reference.

BACKGROUND OF THE INVENTION

1. Field of the Invention

The present invention relates to an electrical component mounting structure for a personal watercraft.

2. Description of Background Art

An electrical component mounting structure for a personal watercraft as shown in FIGS. 15(*a*) and 15(*b*) has been known in Japanese Patent Laid-open No. Hei 10-194195.

A body 1 of the personal watercraft shown in FIGS. 15(*a*) and 15(*b*) is composed of a hull la constituting a lower portion of the body 1 and a deck 1*b* for covering an upper portion of the hull 1*a*. As shown in FIG. 15(*b*), an exhaust outlet 3*a* of an exhaust pipe 3 of an engine 2 disposed in the body 1 is formed on one side in the lateral direction of the body 1.

Batteries 4*a* and 4*b* as main electrical components are symmetrically disposed on the left and right sides of the body 1 as shown in FIG. 15(*b*).

The personal watercraft of this type may be used as a leisure boat, and is therefore often turned over. As a result, a slight amount of water often remains in the body of the watercraft.

According to the above-described related art electrical component mounting structure, since the electrical components 4*a* and 4*b* are symmetrically disposed on the left and right sides of the body 1, when the body 1 in a turn-over state is returned to a normal posture, there may occur a problem that water remaining in the body is necessarily splashed to one of the electrical components 4*a* and 4*b* symmetrically disposed on the left and right sides of the body 1.

For the personal watercraft of this type, the return direction of the body 1 in a turn-over state is generally instructed, by an instruction manual or the like, such that the body 1 should be turned by lifting up the exhaust outlet (opening) 3*a* side (for preventing water from permeating in the opening 3*a*). Accordingly, for the example shown in FIG. 15(*b*), the electrical component 4*a* disposed on the side opposed to the opening 3*a* side (left side in the running direction in FIG. 15(*b*)) is easier to be splashed with water. As a result, there a problem arises in that at least the electrical component 4*a* on the left side must be subjected to a strict waterproof treatment.

SUMMARY AND OBJECTS OF THE PRESENT INVENTION

An object of the present invention is to solve the above-described problem, and to provide an electrical component mounting structure for a personal watercraft, which is capable of preventing electrical components from being splashed with water, thereby simplifying a water-proof treatment thereof.

To achieve the above object, according to a first aspect of the present invention, an electrical mounting structure for a personal watercraft is provided, in which a body of the personal watercraft is composed of a hull constituting a lower portion of the body and a deck for covering an upper portion of the hull, and an exhaust outlet of an exhaust pipe of an engine disposed in the body is formed on one side of the body in the lateral direction, wherein the electrical components are disposed in the body in such a manner as to be offset on the one side from a central portion in the lateral direction. Further, none of the electrical components is disposed in the vicinity of a wall surface constituting the other side of the body.

According to a second aspect of the present invention, the electrical components are disposed in the body at an intermediate portion in the vertical direction.

According to a third aspect of the present invention, at least one of a plurality of the electrical components is mounted to a side wall constituting the one side of the body.

The functions and effects of the present invention are summarized below.

According to the first aspect of the present invention, the electrical components are disposed in the body in such a manner as to be offset on the one side from a central portion in the lateral direction, and none of the electrical components is disposed in the vicinity of a wall surface constituting the other side of the body. As a result, when the body in a turn-over state is turned with the exhaust outlet side lifted up for returning the body to a normal posture, the electrical components are less likely to be splashed with water. Thus, it is possible to simplify a waterproof treatment of the electrical components.

If the electrical components are disposed only at a central portion of the body, which generally is splashed less with water, the layout of the electrical components becomes very difficult because a space in the body of the watercraft is small. However, according to structure described in the first aspect of the invention, it is possible to prevent the electrical components from being splashed with water, without limiting the degree of freedom of the layout of the electrical components.

According to the second aspect of the invention, the electrical components are disposed in the body at an intermediate portion in the vertical direction. As a result, it is possible to further prevent the electrical components from being splashed with water, and hence to further simplify a waterproof treatment of the electrical components.

According to the third aspect of the invention, at least one of a plurality of the electrical components is mounted to a side wall constituting the one side of the body. As a result, it is possible to further suppress the electrical component mounted to the one side of the body from being splashed with water and hence to further simplify a waterproof treatment of the electrical component.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
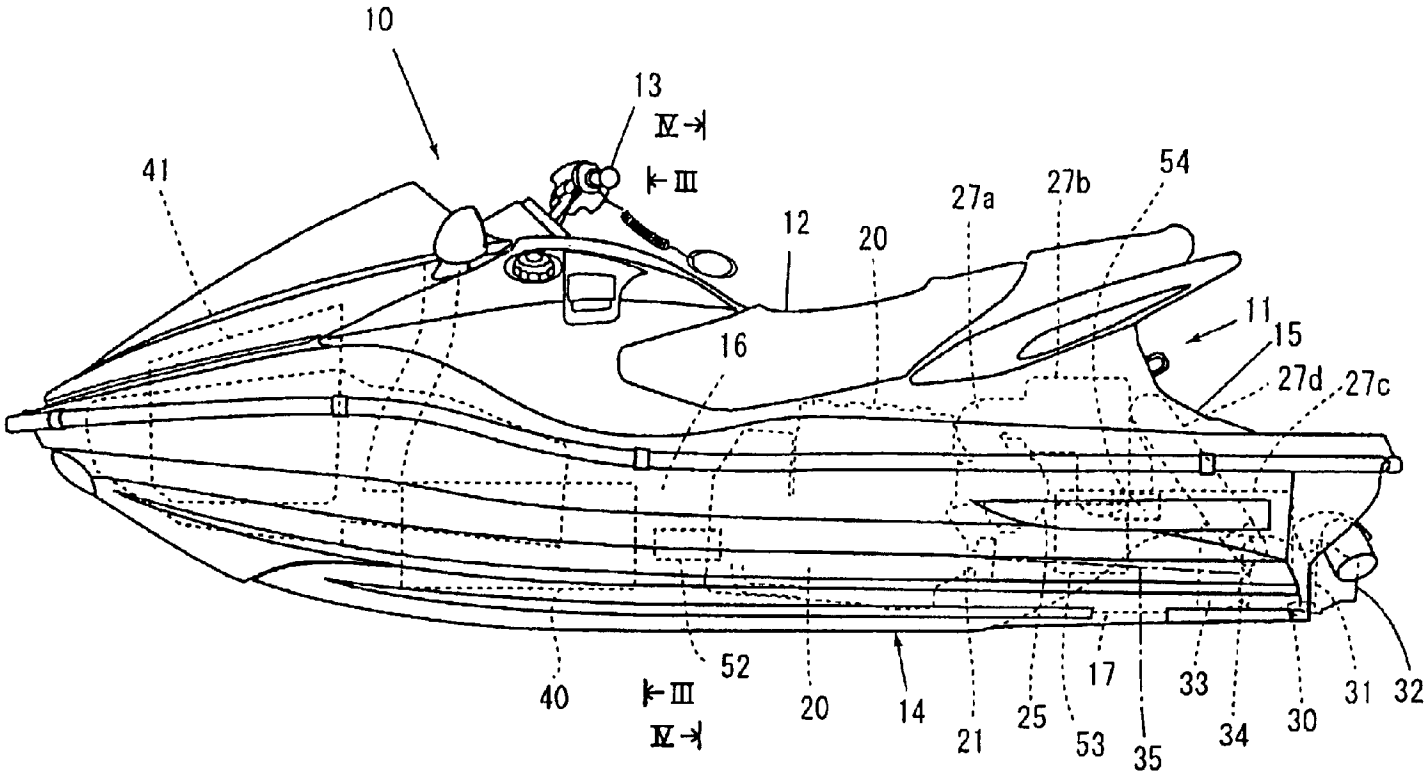
FIG. 1 is a schematic side view showing one example of a personal watercraft to which one embodiment of an electrical component mounting structure for a personal watercraft according to the present invention is applied.
Figure 2:
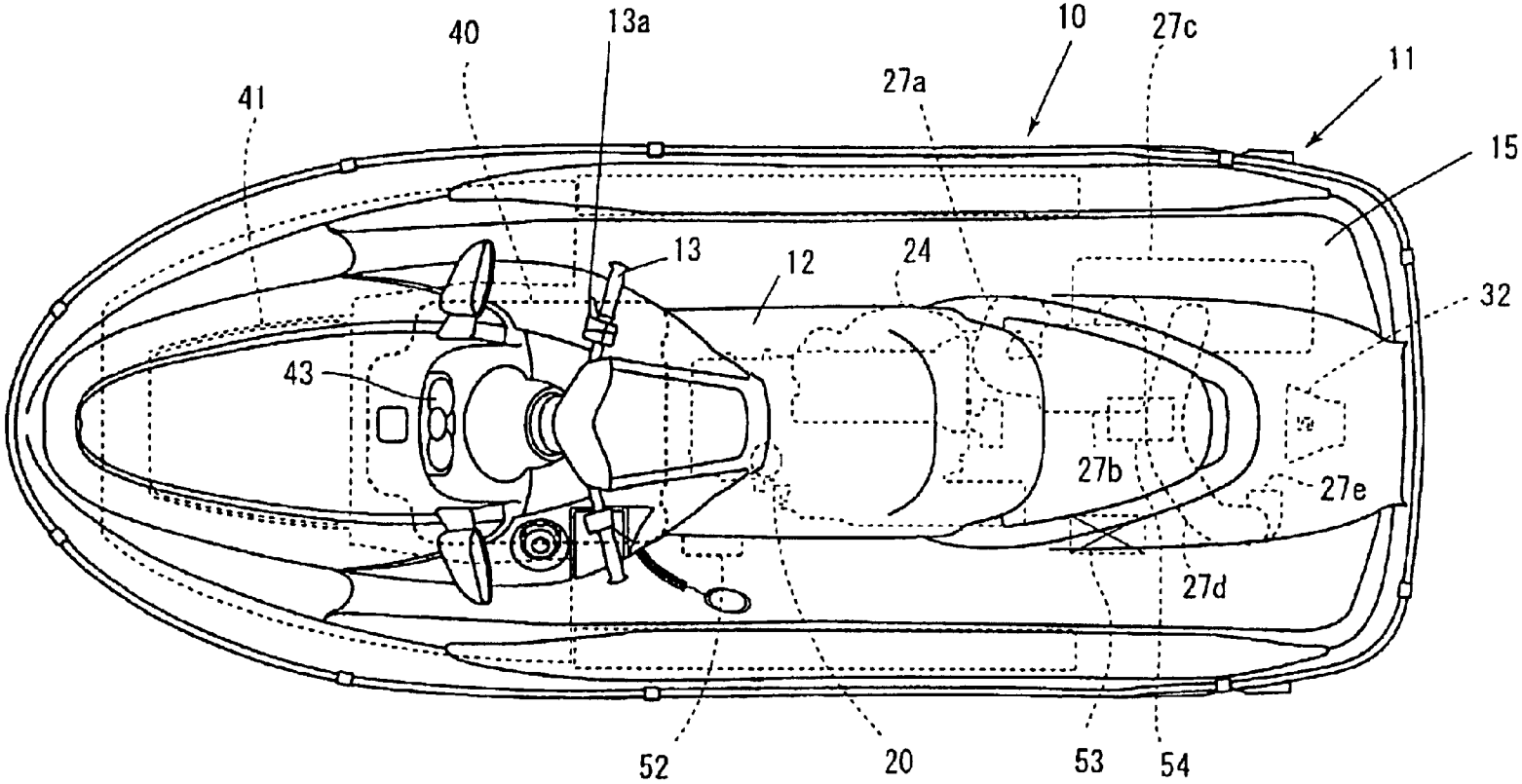
FIG. 2 is a plan view of FIG. 1.
Figure 3:
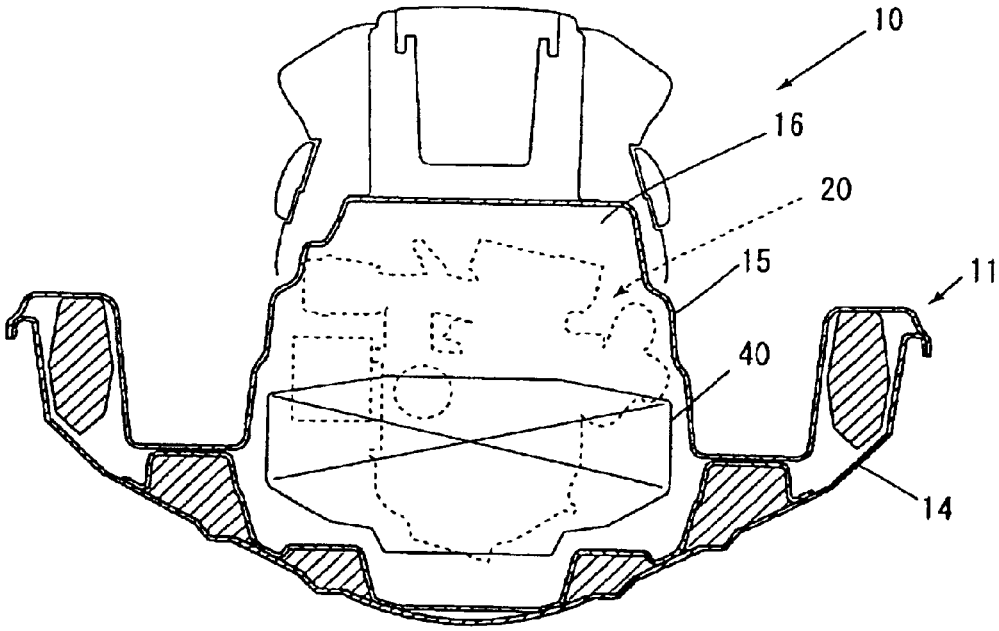
FIG. 3 is an enlarged sectional view taken on line III—III of FIG. 1 (with parts partially omitted)

FIGS. 1 and 2 are a schematic side view and a plan view, respectively, showing one example of a personal watercraft to which one embodiment of an electrical component mounting structure for a personal watercraft according to the present invention is applied. FIG. 3 is an enlarged sectional view taken on line III—III of FIG. 1 (with parts partially omitted).

As shown in these figures (particularly, in FIG. 1), a personal watercraft 10 is a saddle-type small watercraft, which is steerable by a steering handlebar 13 (provided with a throttle lever) gripped by a driver who sits astride a seat 12 on a body 11.

The body 11 has a floating structure in which a deck 15 is joined to a hull 14 so as to form a space 16 therebetween. A water-cooled engine 20 is mounted on the bottom of the hull 14 at an approximately central portion (in both the longitudinal and lateral directions) in the space 16. A jet pump Let propulsion pump) 30 as propelling means to be driven by the water-cooled engine 20 is provided at a rear portion of the hull 14.

The jet pump 30 has a flow passage 33 extending from a water inlet 17 formed in a bottom of the body 11 to a jet port 31 formed in a rear end of the body 11 and to a deflector 32, and also has an impeller 34 disposed in the flow passage 33. A drive shaft 35 of the impeller 34 is coupled with an output shaft 21 of the engine 20. When the engine 20 rotates the impeller 34, water is sucked from the water inlet 17 and is jetted outwardly from the jet port 31 via the deflector 32, to propel the body 11. The rotational speed of the engine 20, that is, a propelling force caused by the jet pump 30 is adjusted by a turning operation of a throttle lever 13*a* of the steering handlebar 13 (see FIG. 2). The deflector 32 is connected to the steering handlebar 13 via an operational wire (not shown). The operation of the steering handlebar 13 turns the deflector 32, to change the running course of the personal watercraft 10.

Also shown in FIGS. 1–3, are a fuel tank 40 and a housing chamber 41.

Figure 4:
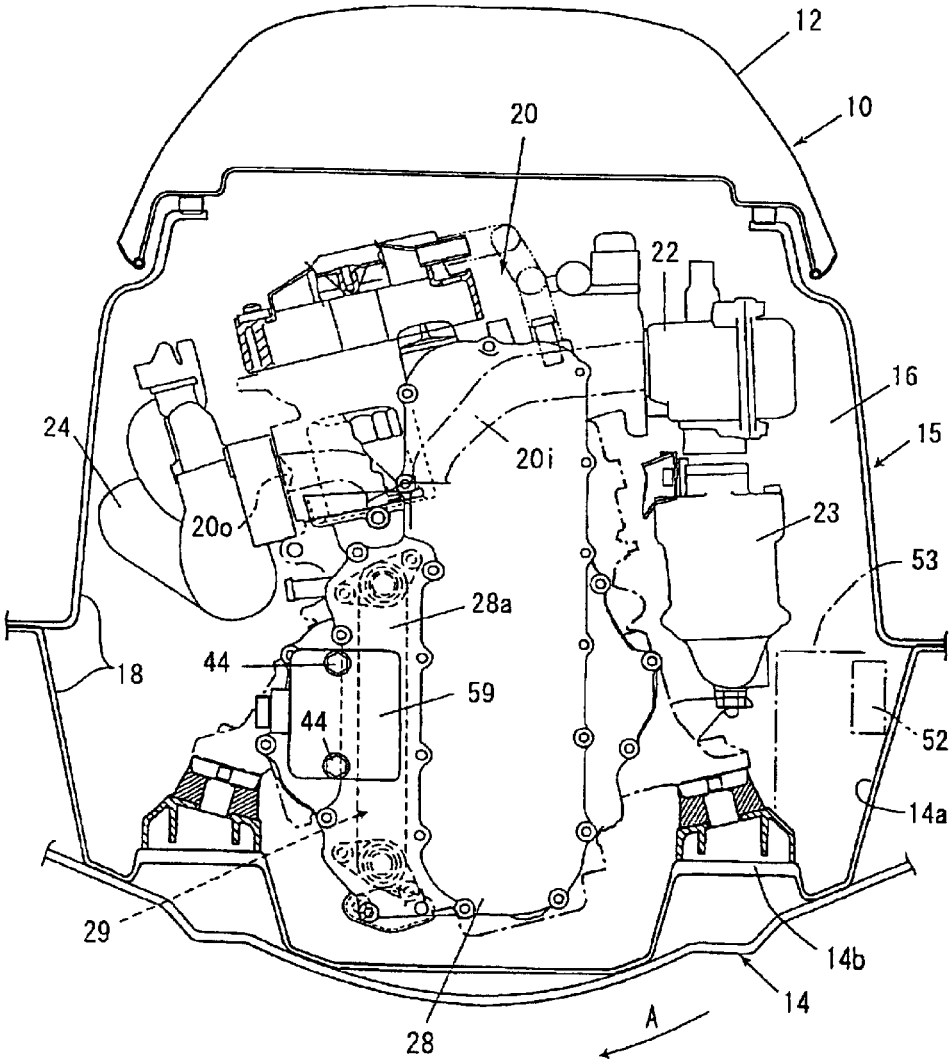
FIG. 4 is an enlarged sectional view taken on line IV—IV of FIG. 1 (with parts partially omitted), mainly showing an engine 20.
Figure 5:
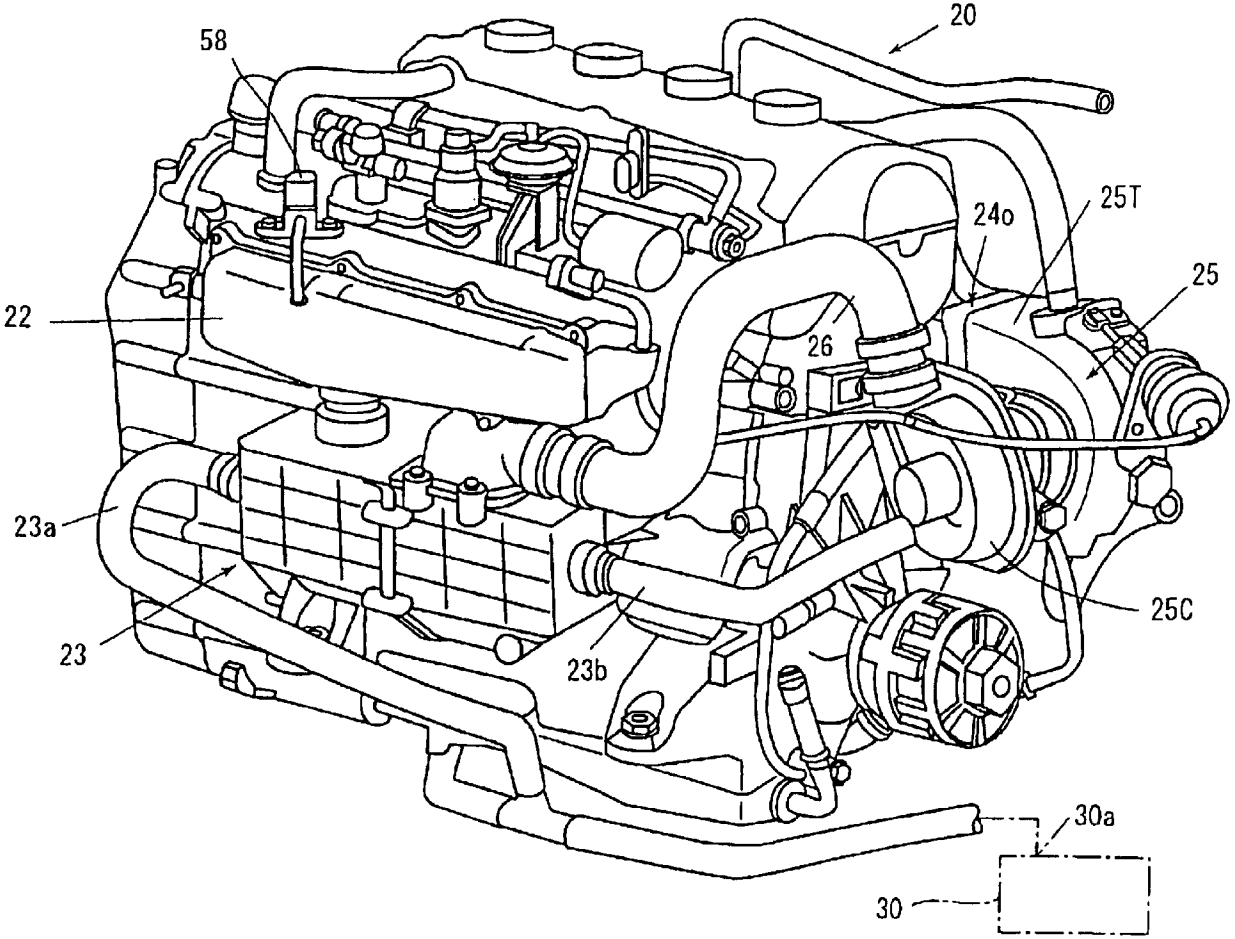
FIG. 5 is a schematic perspective view in which the engine 20 is viewed obliquely from the rear side.

FIG. 4 is an enlarged sectional view taken on line IV—IV of FIG. 1 (with parts partially omitted), mainly showing the water-cooled engine 20, and FIG. 5 is a schematic perspective view in which the engine 20 is viewed obliquely from the rear side.

The water-cooled engine 20 is a dry sump type DOHC four-cycle engine with serial four cylinders, and as shown in FIG. 1, a crankshaft 21 of the engine 20 extends in the longitudinal direction of the body 11.

As shown in FIGS. 4 and 5, a surge tank (intake chamber) 22 communicating with intake ports 20*i* and an inter cooler 23, which are connected to each other, are disposed on the left side of the engine 20 in the running direction of the body 11, and an exhaust manifold 24 communicating with exhaust ports 20*o* is disposed on the right side of the engine 20.

As shown in FIGS. 1 and 5, a turbo-charger 25 is disposed behind the engine 20. An exhaust outlet 24*o* of the exhaust manifold 24 is connected to a turbine portion 25T of the turbo-charger 25, and an inter cooler 23 is connected to the compressor portion 25C by means of a piping line 26 (see FIG. 5). FIG. 5 also shows, cooling water hoses 23*a* and 23*b* connected to the inter cooler 23. Cooling water is supplied from a cooling water outlet 30*a* of the jet pump 30 to the inter cooler 23 via the cooling water hoses 23*a* and 23*b*.

As shown in FIGS. 1 and 2, exhaust gas used for rotating a turbine at the turbine portion 25T of the turbo-charger 25 flows through an exhaust pipe 27*a*, a anti-counterflow chamber 27*b* for preventing counterflow of water (permeation of water in the turbo-charger 25 and the like) at the time of turn-over the watercraft, a water muffler 27*c*, and an exhaust/drain pipe 27*d*. Finally, the exhaust gas is discharged outwardly from the body 11 from an exhaust outlet (serving as water outlet) 27*e*.

As is apparent from FIG. 2, according to this embodiment, the exhaust outlet 27*e* is formed on the left side of the watercraft 10 (as viewed in the running direction).

Figure 6:
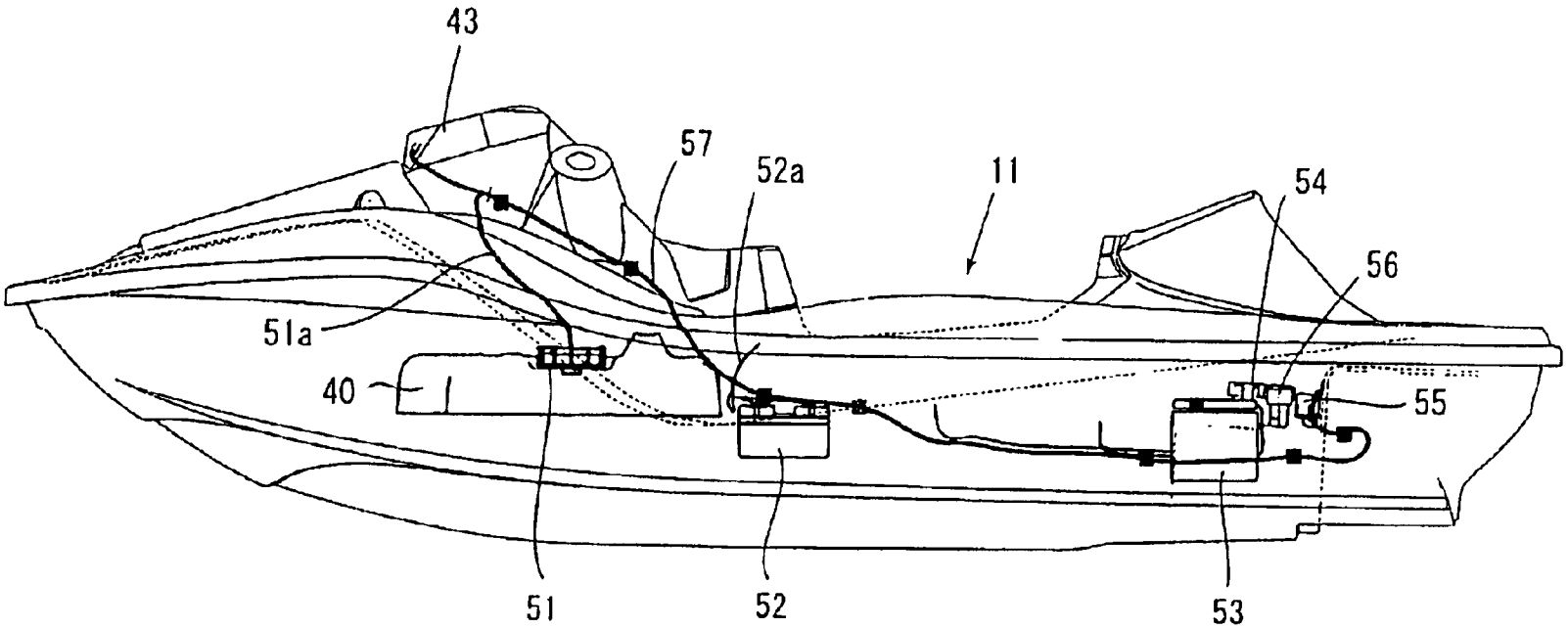
FIG. 6 is a perspective side view, with parts partially omitted, mainly showing an electrical component mounting structure.
Figure 7:
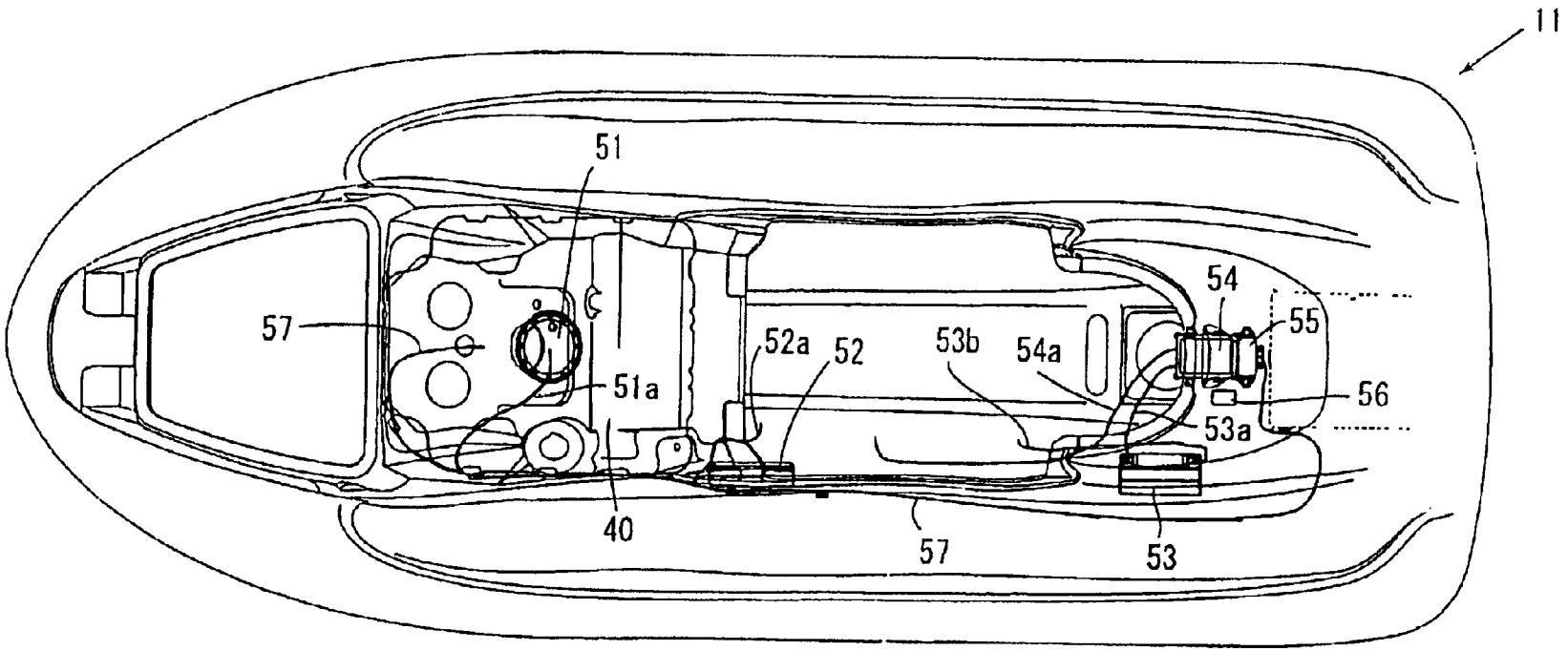
FIG. 7 is a perspective plan view, with parts partially omitted, mainly showing an electrical component mounting structure.

FIGS. 6 and 7 mainly show an electrical component mounting structure, wherein FIG. 6 is a perspective side view, with parts partially omitted, and FIG. 7 is a perspective plan view, with parts partially omitted.

FIGS. 6 and 7 show electrical components 51 to 56. These electrical components 51 to 56 are disposed in the body 11 in such a manner as to be offset on the left side from a central portion in the lateral direction (as viewed in the running direction), and none of the electrical components is disposed in the vicinity of a wall surface 18 (see FIG. 4) of the body 11, which wall surface constitutes the other side (right side).

As is apparent from FIG. 6, the electrical components 51 to 56 are disposed in an intermediate portion in the body 11 in the vertical direction.

Various sensors, for example, a supercharging sensor 58 for detecting an air pressure (supercharging pressure) in the surge tank 22 shown in FIG. 5, are mounted to the engine 20. Since the engine 20 is mounted to an approximately central portion in the body 11, the various sensors are also disposed in the approximately central portion in the body 11.

FIG. 4 shows a rectifier 59 connected to a generator of the engine 20. A water tank (cooling water passage) 28*a* is provided adjacently to an oil tank 28 provided integrally with a front surface of the engine 20, and the rectifier 59 is mounted to a front surface of the water tank 28*a* with bolts 44. An oil cooler 29 is provided in the water tank 28*a*.

In this embodiment, the electrical component 51 is a residual fuel amount sensor mounted to the fuel tank 40, the electrical component 52 is an ECU (engine control unit), the electrical component 53 is a battery, the electrical component 54 is a magnet box, the electrical component 55 is a main relay, and the electrical component 56 is a fuse box. These electrical components are connected to each other by means of electrical cables 51*a*, 53*a*, 57, and the like, and are also connected to a display panel 43 (see FIG. 2) of the watercraft 10. The ECU 52, battery 53, and magnet box 54 are connected to electrical components of the engine 20 via electrical cables 52*a*, 53*b*, and 54*a*.

Figure 8:
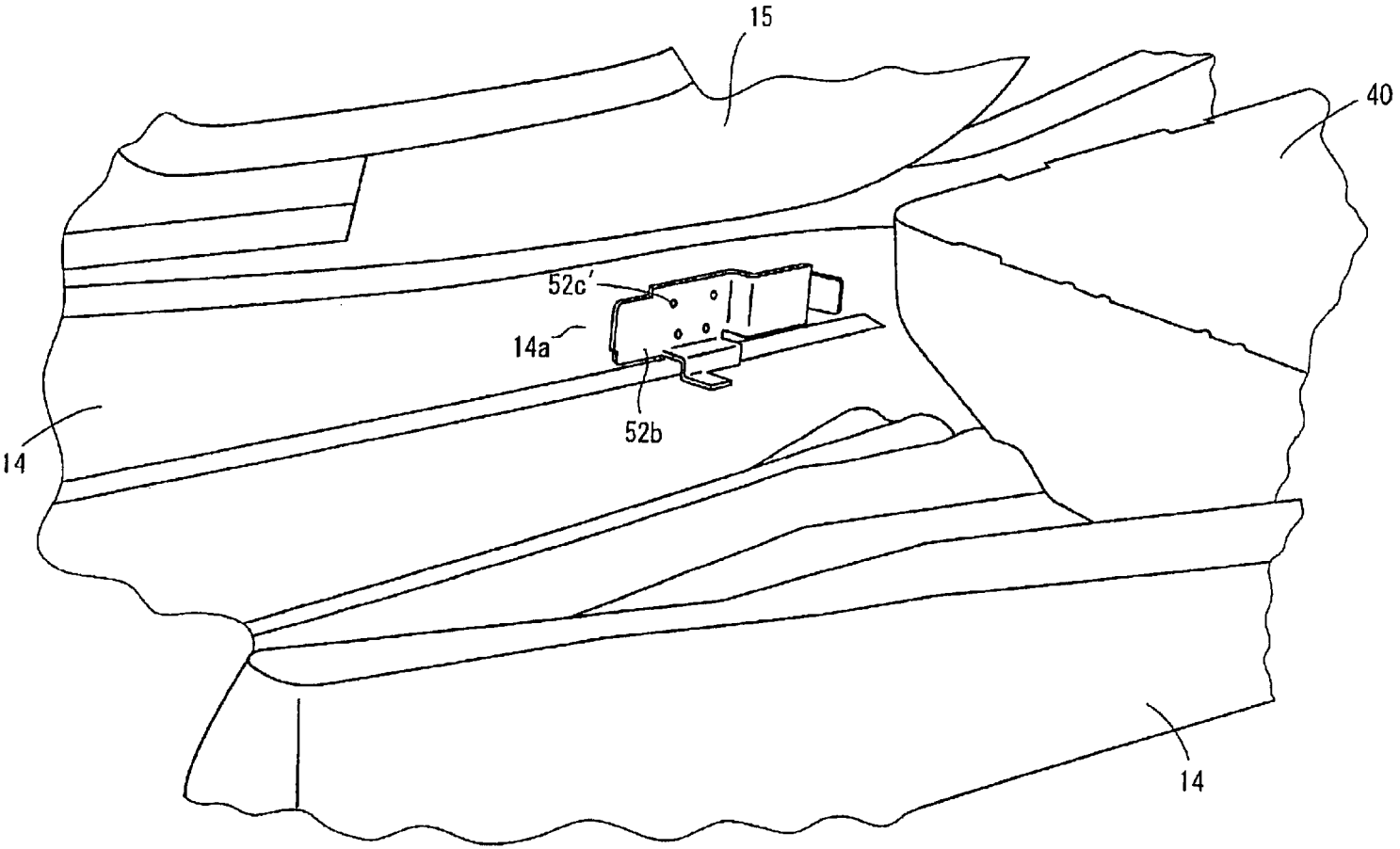
FIG. 8 is a perspective view showing a mounting state of a mounting member 52*b* of an electrical component 52.
Figure 9:
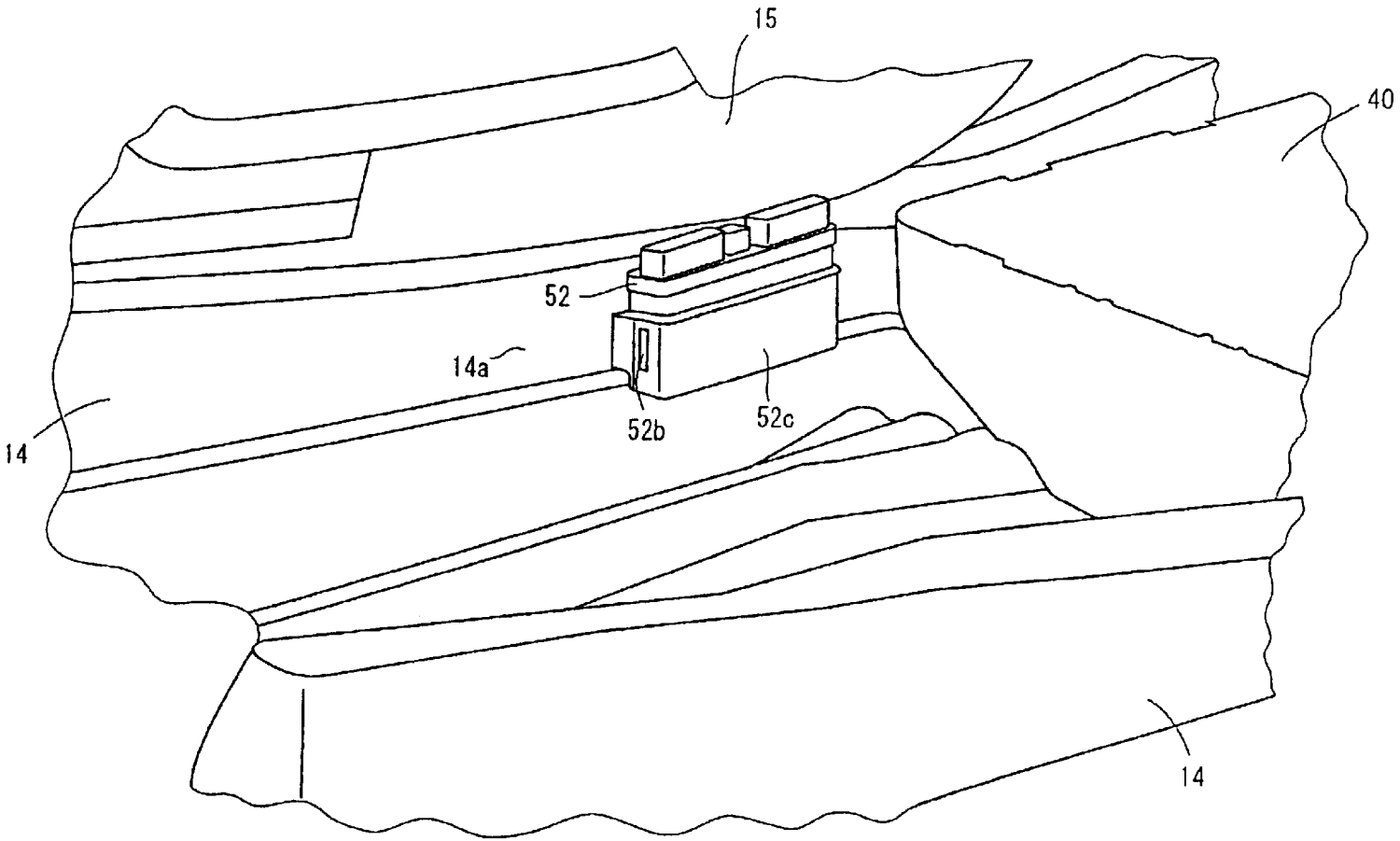
FIG. 9 is a perspective view showing a mounting state of the electrical component 52.

The ECU 52 is mounted as described below. A mounting member 52*b* is, as shown in FIG. 8, fixed to a side wall 14*a* of the hull 14 with rivets 52*c*'. A stay 52*c* composed of a suspension rubber boot is, as shown in FIG. 9, mounted to the mounting member 52*b*. The ECU 52 is mounted to the stay 52*c*.

The ECU 52 is thus mounted to the side wall 14*a* on the exhaust outlet 27*e* side of the body 11 (see FIG. 4).

Figure 10:
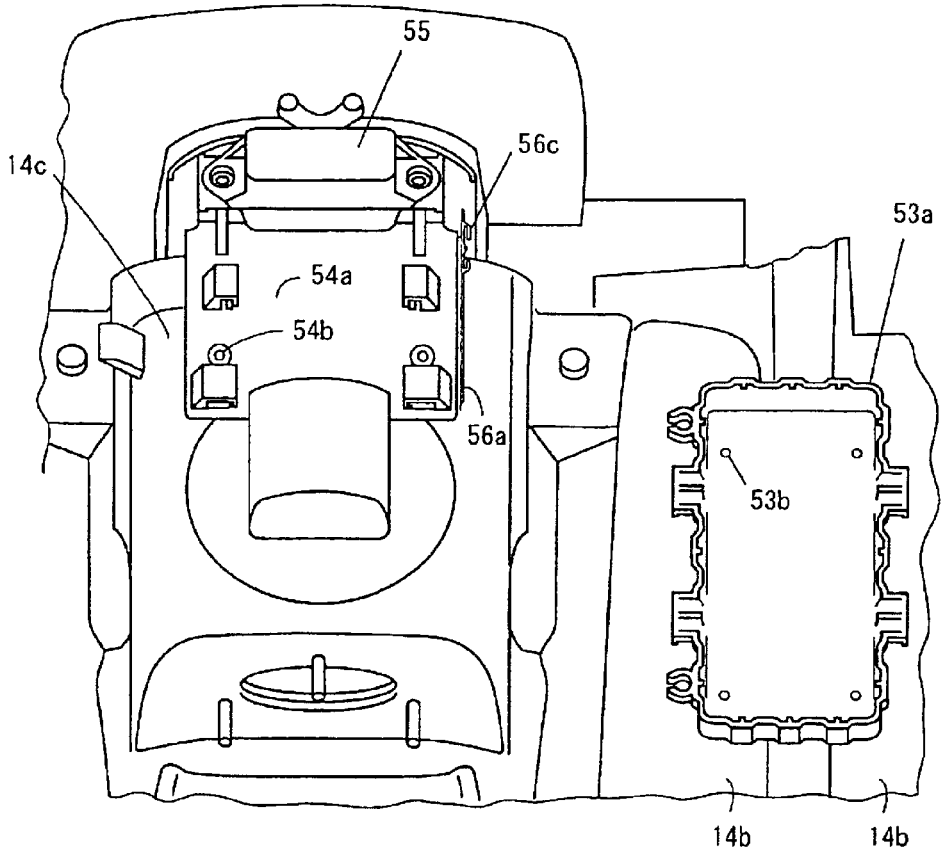
FIG. 10 is a perspective view showing, substantially from above, mounting states of mounting members of electrical components 53 to 56.
Figure 11:
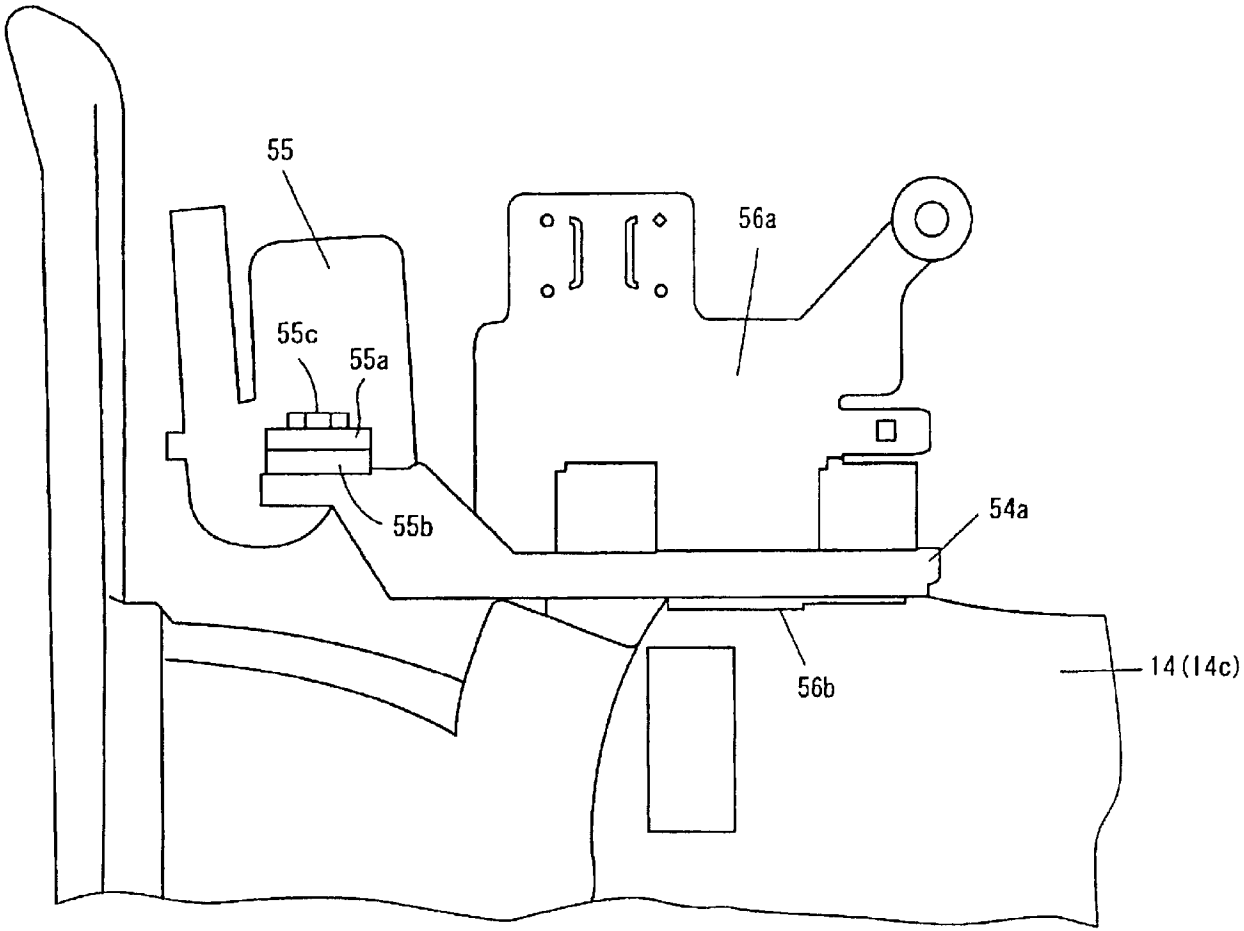
FIG. 11 is a left side view of FIG. 10.
Figure 12:
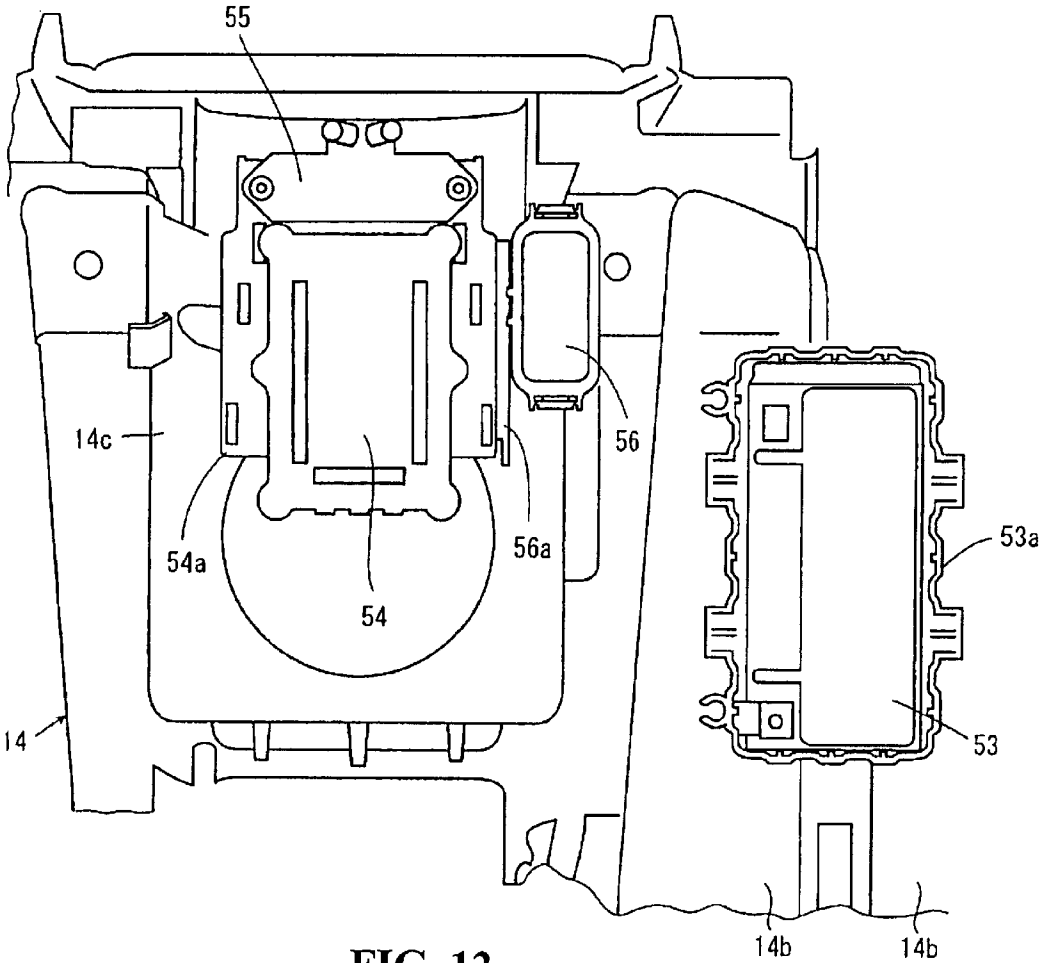
FIG. 12 is a plan view showing the mounting states of the electrical components 53 to 56.
Figure 13:
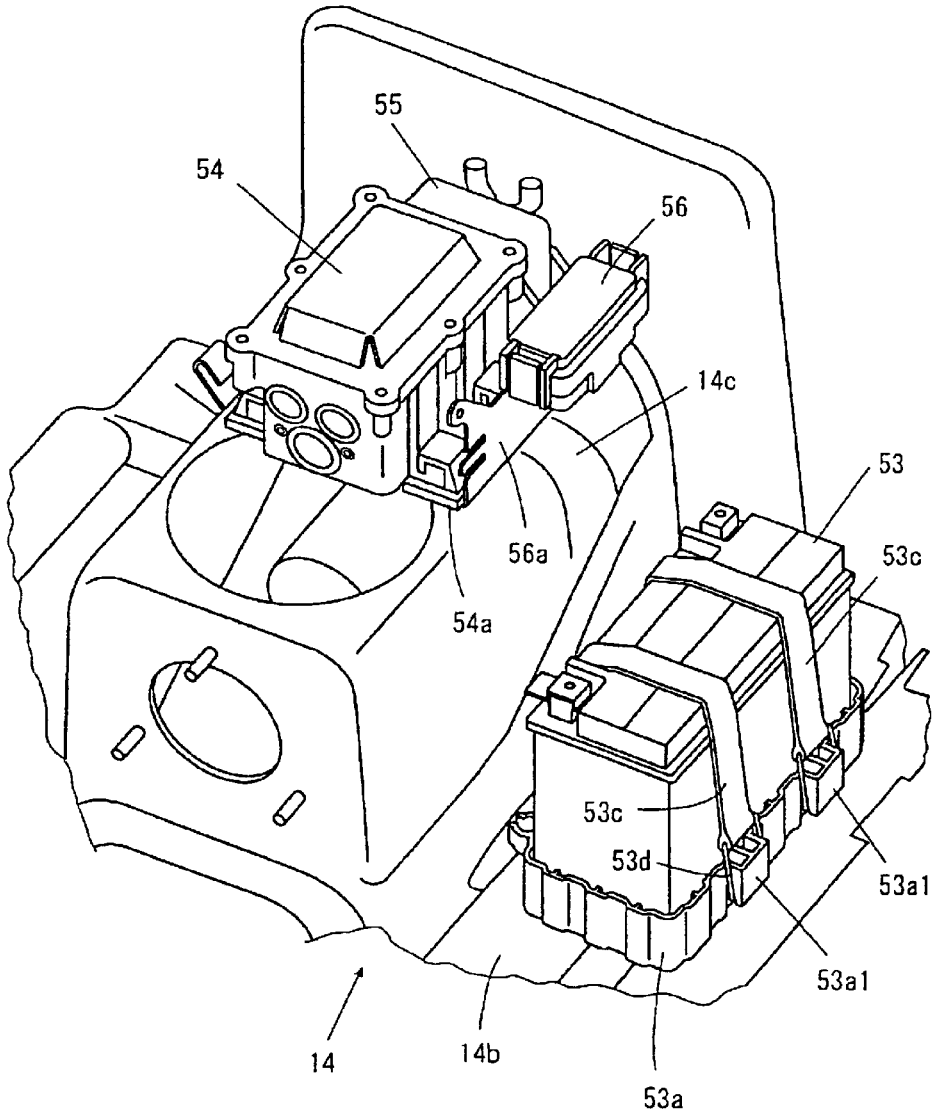
FIG. 13 is a perspective view showing the mounting states of the electrical components 53 to 56.
Figure 14:
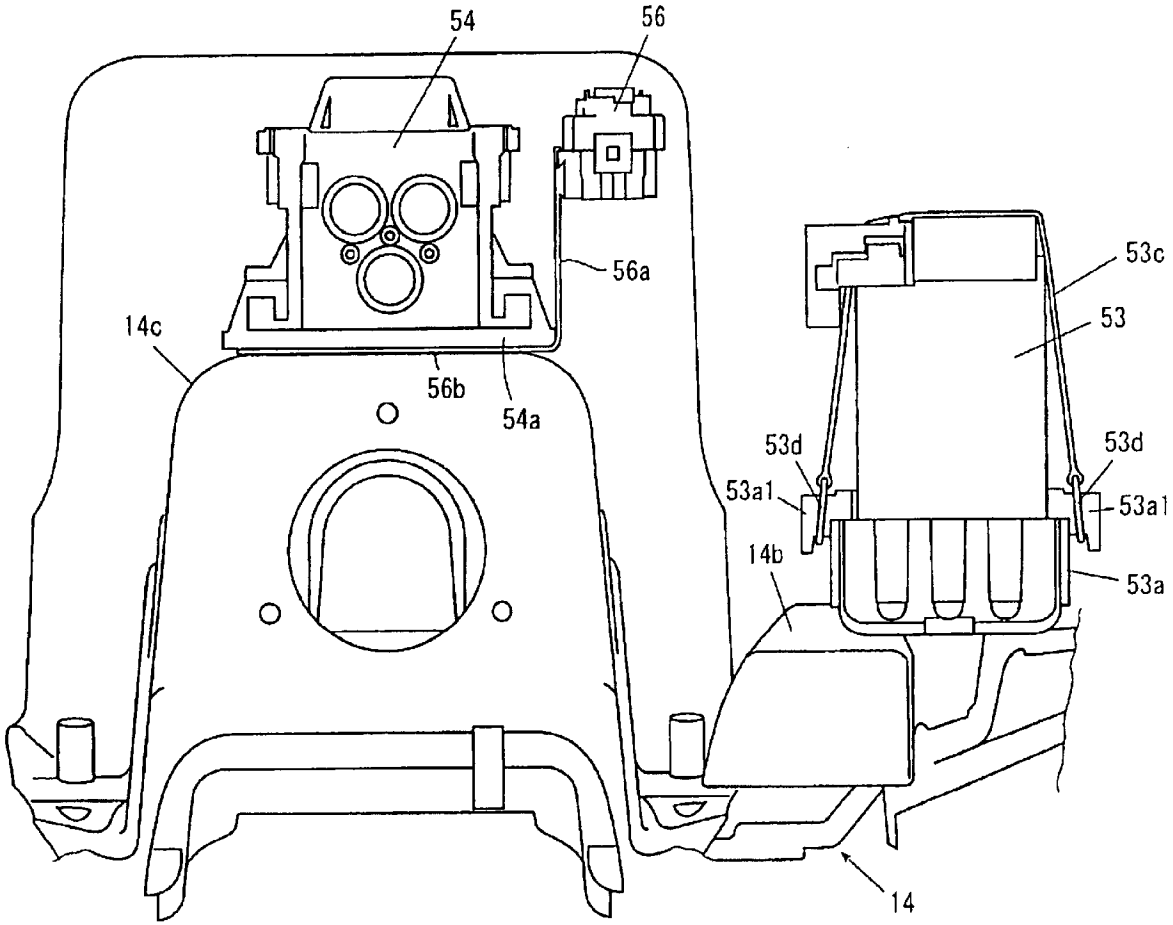
FIG. 14 is a front view showing the mounting states of the electrical components 53 to 56.
Figure 15:
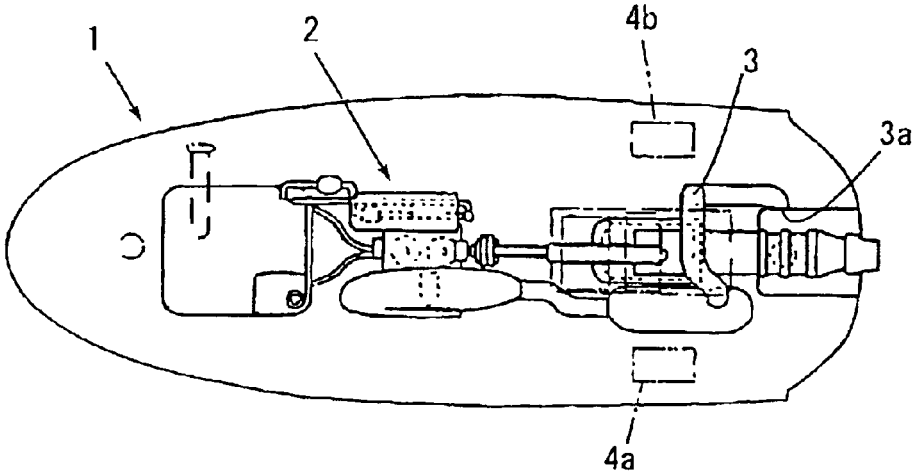
FIGS. 15(*a*) and 15(*b*) are views illustrating a related art electrical component mounting structure for a personal watercraft.
Figure 15:
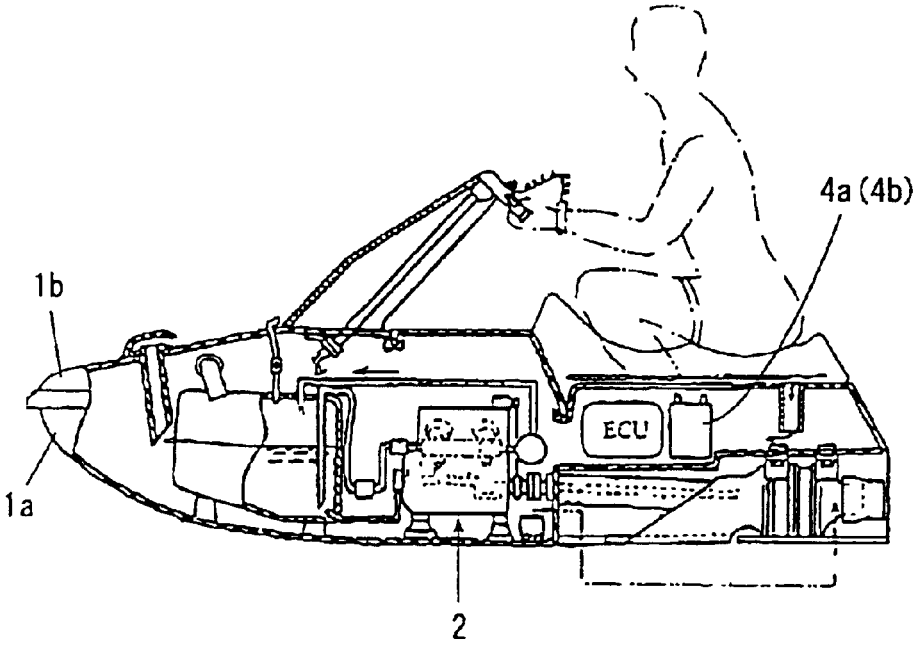

FIGS. 10 to 14 are views showing mounting states of the battery 53, magnet box 54, main relay 55, and fuse box 56. Specifically, FIG. 10 is a perspective view showing, substantially from above, the mounting states of the electrical components 53 to 56; FIG. 11 is a left side view of FIG. 10; and FIGS. 12, 13, and 14 are a plan view, a perspective view, and a front view, showing the mounting states of the electrical components 53 to 56, respectively.

The battery 53 is mounted as described below. A battery tray 53*a* is, as shown in FIG. 10, is fixed on an upper surface of a rib 14*b* (see FIG. 4), which is provided on a bottom surface of the hull 14, with rivets 53*b*. A shown in FIGS. 12 to 14, the battery 53 is mounted on the battery tray 53*a*. The battery 53 is thus mounted on the left side of the body 11. Reference numeral 53*c* denotes a rubber belt for fixing the battery 53 to the battery tray 53*a*. The rubber belt 53*c* is removably connected to hook portions 53*a*1 on both sides of the battery tray 53*a* with connection fixtures 53*d* provided on both ends of the rubber belt 53*c*.

The magnet box 54 is mounted as described below. As shown in FIGS. 10 and 11, a base 54*a* is fixed to an upper surface of the housing portion 14*c* of the jet pump 30, which is provided on the bottom surface of the hull 14, with rivets 54*b*. As shown in FIGS. 12 to 14, the magnet box 54 is mounted to the base 54*a*. The magnet box 54 is thus mounted to a central portion of the body 11.

The main relay 55 is mounted as described below. As shown in FIG. 11, a flange portion 55*a* of the main relay 55 is fastened, via a collar and-a rubber bush 55*b*, to a rear portion of the base 54*a* with a bolt 55*c*. The main relay 55 is thus mounted to a central portion of the body 11.

The fuse box 56 is mounted as described below. As shown in FIGS. 10 and 11, bottom plate 56*b* of a stay 56*a* is inserted between the base 54*a* and the upper surface of the housing portion 14*c* of the jet pump 30 provided on the hull 14, and the stay 56*a* is fixed, together with the base 54*a*, to the hull 14 with the rivets 54*b*. As shown in FIGS. 12 to 14, the fuse box 56 is mounted to an upright portion of the stay 56*a* by making use of a hook portion 56*c* of the stay 56*a*. The fuse box 56 is thus mounted to a central portion of the body 11.

The electrical component mounting structure for a personal watercraft, which is configured as described above, has the following functions and effects:

(a) The body 11 of the personal watercraft is composed of the hull 14 constituting a lower portion of the body 11 and a deck 15 for covering an upper portion of the hull 14, and the exhaust outlet 27*e* of the exhaust pipe 27*d* of the engine 20 disposed in the body 11 is formed on one side (left side in this embodiment) of the body 11 in the lateral direction. In this personal watercraft, the electrical components 51 to 56 are disposed in the body 11 in such a manner as to be offset on the one side (left side in this embodiment) from a central portion in the lateral direction, and none of the electrical components is disposed in the vicinity of the wall surface 18 constituting the other side (right side in this embodiment) of the body 11.

As a result, when the body 11, which is in a turn-over state, is turned with the exhaust outlet 27*e* side lifted up for returning the body 11 to a normal posture (when the body 11 in a state inverted from that shown in FIG. 4 is turned in the direction shown by an arrow A), the electrical components 51 to 56 are less likely to be splashed with water. Thus, it is possible to simplify a water-proof treatment of the electrical components 51 to 56.

If the electrical components 51 to 56 are disposed only at a central portion of the body 11 less splashed with water, the layout of the electrical components 51 to 56 becomes very difficult because a space 16 in the body 11 of the watercraft is small. However, according to the electrical component mounting structure for a personal watercraft of the present invention, it is possible to make the degree of freedom of the layout of the electrical components 51 to 56 large while suppressing the electrical components 51 to 56 from being splashed with water.

(b) Since the electrical components 51 to 56 are disposed in the body 11 at an intermediate portion in the vertical direction, it is possible to further prevent the electrical components 51 to 56 from being splashed with water. Hence, a water-proof treatment of the electrical components 51 to 56 is further simplified.

(c) Since at least one electrical component 52 of a plurality of the electrical components 51 to 56 is mounted to a side wall 14*a* constituting the one side of the body 11, it is possible to further prevent the electrical component 52 mounted to the one side of the body 11 from being splashed with water, and hence, to further simplify a water-proof treatment of the electrical component 52.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical mounting structure for a personal watercraft, comprising:

a body of said personal watercraft composed of a hull constituting a lower portion of said body and a deck for covering an upper portion of said hull; and a first side of said body in a lateral direction, said first side of said body having an exhaust outlet of an exhaust pipe of an engine, wherein a plurality of electrical components is disposed in said body in such a manner as to be offset on said first side from a central portion in the lateral direction, and none of said plurality of electrical components is disposed in the vicinity of a wall surface constituting a second side of said body, said second side being opposite to said first side, wherein at least one of said plurality of said electrical components is mounted to a side wall constituting said first side of said body.

2. The electrical component mounting structure for a personal watercraft according to claim 1, wherein said electrical components are disposed in said body at an intermediate portion in the vertical direction.

3. The electrical component mounting structure for a personal watercraft according to claim 1, wherein said first side of the body is the left side of the body as viewed in a running direction.

4. The electrical component mounting structure for a personal watercraft according to claim 1, wherein said at least one of said plurality of electrical components mounted on said side wall constituting said first side is an ECU, said ECU being mounted to a stay, the stay being mounted to a mounting member which is fixed to said side wall with rivets.

5. The electrical component mounting structure for a personal watercraft according to claim 4, wherein another one of said plurality of electrical components is a battery, said battery being fixed to an upper surface of a rib at a position to the rear of said ECU.

6. The electrical component mounting structure for a personal watercraft according to claim 4, wherein others of said plurality of electrical components are a main relay and a fuse box, said main relay and said fuse being mounted to a housing portion of a jet pump at a central portion of the body.

7. A personal watercraft, comprising:

an engine for powering a jet pump of the watercraft;

a body composed of a hull constituting a lower portion of said body and a deck for covering an upper portion of said hull;

a first side of said body in a lateral direction, said first side of said body having an exhaust outlet of an exhaust pipe of said engine, wherein a plurality of electrical components is disposed in said body in such a manner as to be offset on said first side from a central portion in the lateral direction, and none of said plurality of electrical components is disposed in the vicinity of a wall surface constituting a second side of said body, said second side being opposite to said first side, wherein at least one of said plurality of said electrical components is mounted to a side wall constituting said first side of said body.

8. The personal watercraft according to claim 7, wherein said electrical components are disposed in said body at an intermediate portion in the vertical direction.

9. The personal watercraft according to claim 7, wherein said first side of the body is the left side of the body as viewed in a running direction.

10. The electrical component mounting structure for a personal watercraft according to claim 7, wherein said at least one of said plurality of electrical components mounted on said side wall constituting said first side is an ECU, said ECU being mounted to a stay, the stay being mounted to a mounting member which is fixed to said side wall with rivets.

11. The personal watercraft according to claim 10, wherein another one of said plurality of electrical components is a battery, said battery being fixed to an upper surface of a rib at a position to the rear of said ECU.

12. The personal watercraft according to claim 10, wherein others of said plurality of electrical components are a main relay and a fuse box, said main relay and said fuse being mounted to a housing portion of said jet pump at a central portion of the body.

13. An electrical mounting structure for a personal watercraft, comprising:

a body of said personal watercraft composed of a hull constituting a lower portion of said body and a deck for covering an upper portion of said hull; and a first side of said body in a lateral direction, said first side of said body having an exhaust outlet of an exhaust pipe of an engine, an entirety of said exhaust outlet being located on said first side of said body, wherein a plurality of electrical components is disposed in said body in such a manner as to be offset on said first side from a central portion in the lateral direction, and none of said plurality of electrical components is disposed in the vicinity of a wall surface constituting a second side of said body, said second side being opposite to said first side.

* * * * *